US011432620B2

(12) United States Patent
Steinke, II

(10) Patent No.: US 11,432,620 B2
(45) **Date of Patent: *Sep. 6, 2022**

(54) SNAP AND LOCK

(71) Applicant: Richard P. Steinke, II, Indio, CA (US)

(72) Inventor: Richard P. Steinke, II, Indio, CA (US)

( * ) Notice: Subject to any disclaimer, the term of this patent is extended or adjusted under 35 U.S.C. 154(b) by 24 days.

This patent is subject to a terminal disclaimer.

(21) Appl. No.: 15/873,168

(22) Filed: Jan. 17, 2018

(65) Prior Publication Data

US 2018/0199677 A1 Jul. 19, 2018

Related U.S. Application Data

(60) Provisional application No. 62/447,344, filed on Jan. 17, 2017.

(51) Int. Cl.
*A44B 17/00* (2006.01)

(52) U.S. Cl.
CPC ..... *A44B 17/0082* (2013.01); *A44B 17/0005* (2013.01); *A44B 17/007* (2013.01); *A44B 17/0023* (2013.01); *A44B 17/0052* (2013.01); *A44D 2201/04* (2013.01); *A44D 2201/06* (2013.01)

(58) Field of Classification Search
CPC ..... A44B 17/0005; A44B 17/0023; A44B 17/0052; A44B 17/007; A44B 17/0082; A44D 2201/04; A44D 2201/06
See application file for complete search history.

(56) References Cited

U.S. PATENT DOCUMENTS 2,723,433 A * 11/1955 Buren, Jr. ..... A44B 17/0005 24/90.1
3,045,309 A * 7/1962 Johnson, Sr. ..... A44B 17/0082 24/689
3,718,950 A * 3/1973 Engstrom ..... F16B 5/0642 411/347
3,979,802 A * 9/1976 Bongartz ..... A44B 17/0052 24/630
4,137,607 A * 2/1979 Kramer ..... A44B 1/04 24/95
4,580,320 A * 4/1986 Takata ..... A44B 1/02 24/113 MP
4,959,890 A * 10/1990 Pazurek ..... A44B 1/04 24/113 MP
6,009,601 A * 1/2000 Kaufman ..... A41F 1/002 24/303
6,564,434 B1 * 5/2003 Morita ..... A45C 13/1069 24/114.2
6,895,642 B2 * 5/2005 Huang ..... A47G 1/17 24/303

(Continued)

*Primary Examiner* — David M Upchurch
(74) *Attorney, Agent, or Firm* — Law Office of Michael O'Brien; Michael O'Brien

(57) ABSTRACT

A button system containing two pieces that snap and lock together to fasten multiple articles of clothing. The top piece is made of three distinct parts: a detachable ridged color-coded cover, a fastener that attaches said cover to a rotatable hinged plate, and a fastener that secures all three pieces of the top piece. The bottom piece is also made up of three distinct parts: a plate to receive the hinges from the top piece, a curved structure that connects the hinge/cavity plates to the article of clothing, and a rivet that attaches to the article of clothing and the snap and lock invention.

1 Claim, 10 Drawing Sheets

(56) References Cited

U.S. PATENT DOCUMENTS

| | | | | |
|---|---|---|---|---|
| 7,856,697 | B2 * | 12/2010 | Quimod | A44B 1/04 24/113 R |
| 9,307,806 | B1 * | 4/2016 | Dorman | A44B 17/0005 |
| 2005/0223527 | A1 * | 10/2005 | Raccosta | A44B 17/0052 24/90.1 |
| 2011/0225781 | A1 * | 9/2011 | Cameron | A44B 17/0082 24/459 |
| 2012/0079645 | A1 * | 4/2012 | Carlson | A44B 17/0047 2/265 |
| 2014/0317822 | A1 * | 10/2014 | Friedman | A44B 17/0082 2/69 |
| 2015/0053060 | A1 * | 2/2015 | Coakley | F16C 19/54 83/745 |
| 2015/0059060 | A1 * | 3/2015 | Schoenbeck | A43B 17/00 2/239 |
| 2016/0000189 | A1 * | 1/2016 | Bolen | A44B 1/30 24/303 |
| 2016/0270487 | A1 * | 9/2016 | Chen | A44B 17/007 |
| 2017/0210611 | A1 * | 7/2017 | Bingham | B68G 13/02 |
| 2017/0288338 | A1 * | 10/2017 | Komoto | H01R 13/6278 |

* cited by examiner

SNAP AND LOCK

FIELD OF THE INVENTION

This invention relates to the field of buttons, specifically fasteners for articles of clothing.

BACKGROUND OF THE INVENTION

Traditional buttons have long been used to easily fasten multiple articles of clothing together. A negative trait of the ease of traditional buttons is the ease at which they become undone. The present invention sets forth a novel system to allow the user to rotate the fastening device into a locked position to secure multiple articles of clothing and prevent unwanted detachment of said articles of clothing. This invention is particularly useful in athletics, action sports, and extreme conditions.

SUMMARY OF THE INVENTION

The snap and lock invention is similar to a traditional button designed for an article of clothing, generally two pieces that snap together to fasten multiple articles of clothing. This invention comprises the traditional two pieces, however, each piece incorporates novel concepts. The top piece is made up of three parts: (1) a detachable ridged color-coded cover that is used as both a pressure point to secure the invention, and a grip to rotate the invention in and out of the locked position, (2) a male fastener that attaches the rigged cover to the (3) plate with hinges that functions as the bottom of the top piece of the snap and lock. The hinged place contains a female fastener that secures all three pieces of the top portion. The bottom piece of the snap and lock invention is also made up of three parts: (1) a plate to receive the hinges from the top piece, with a cavity to allow the hinges to rotate counterclockwise 37 to 42 degrees into a locked position, and with bumper guards to prevent the hinges from over rotation, (2) a curved structure that serves to connect the hinge/cavity plates and the article of clothing attachment, and (3) a rivet that attaches to the article of clothing and the snap and lock invention.

BRIEF DESCRIPTION OF THE DRAWINGS

The foregoing and other features of the invention will become apparent from the following drawings and detailed description of the preferred embodiment of the invention.

DETAILED DESCRIPTION OF THE PREFERRED EMBODIMENT

Figure 1:
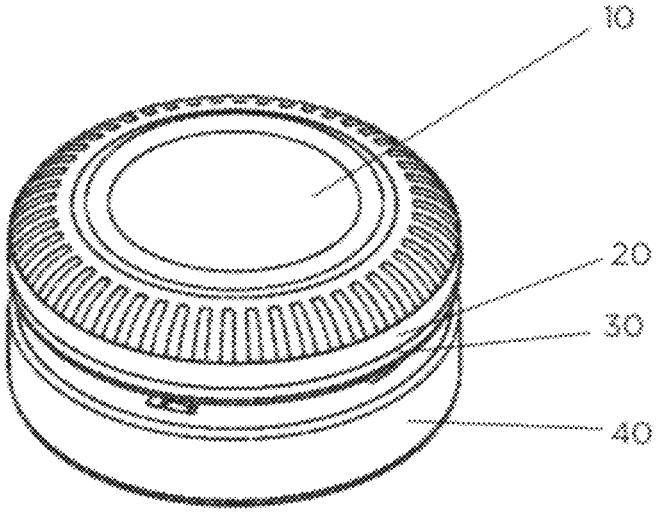
FIG. 1 is a front schematic view of the snap and lock button device.

FIG. 1 is a front schematic view of the invention in the preferred embodiment. The preferred embodiment is not intended to limit the scope of the invention. The preferred embodiment of the invention includes six parts: the replaceable, detachable, and interchangeable ridged top 10, the plate 20 containing the male fastener, the plate 30 containing the female fastener which connects to plate 20 and also contains hinges 31 on the reverse side of the female fastener, the plate 40 that receives the hinges 31 in cavities 41, a structure 50 that receives the united plate 20 and plate 30 and allows the combined plates 20 and 30 to be rotated together into a fixed and secure position, and a rivet 60 that attaches the invention to an article of clothing.

Figure 2A:
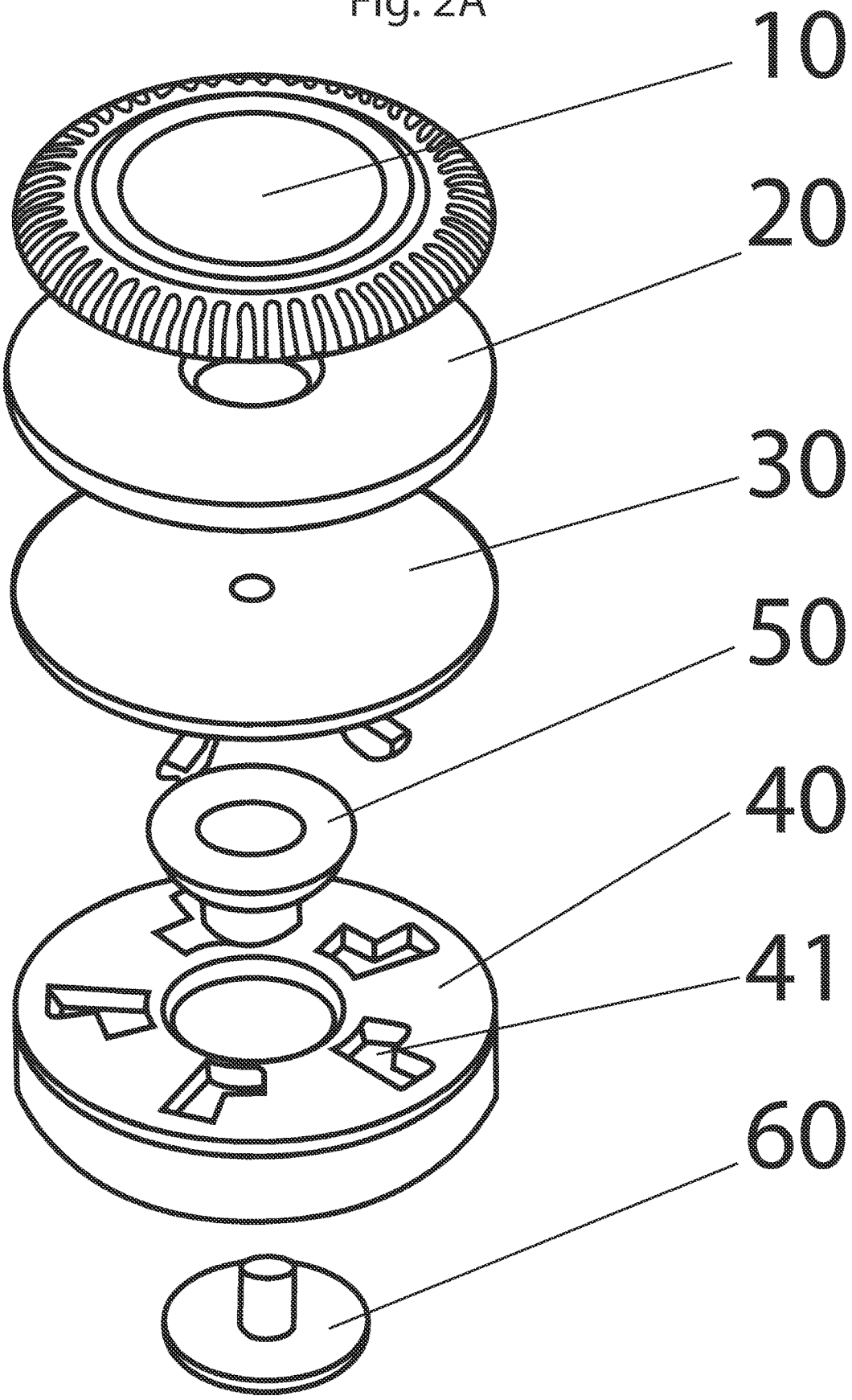
FIG. 2A is a semi-exploded view of the device shown in FIG. 1.

FIG. 2A is a semi-exploded view of the invention in the preferred embodiment. the replaceable, detachable, and interchangeable ridged top 10 is shown separated from the plate 20. The plate 30 containing the female fastener and hinges 31 is shown detached from the plate 20 containing the male fastener. The plate 30 containing the female fastener and hinges 31 is shown detached from the plate 40 that receives the hinges 31. Structure 50 that receives the united plate 20 and plate 30 is shown detached from combined plates 20 and 30. Rivet 60 is shown detached from the invention and from an article of clothing.

Figure 2B:
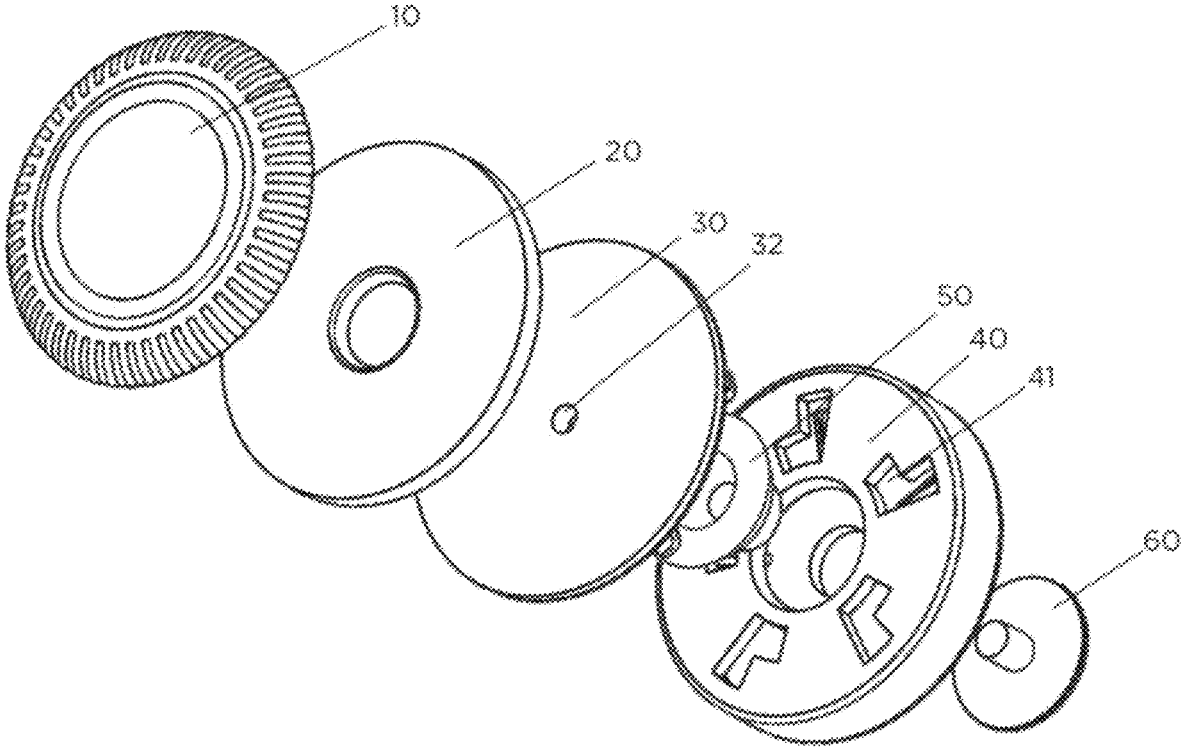
FIG. 2B is a semi-exploded angled view of the device shown in FIG. 1.

FIG. 2B is an angled semi-exploded view of the invention in the preferred embodiment and while incorporating the detailed description of FIG. 2A above, also shows female fastener 32.

Figure 3:
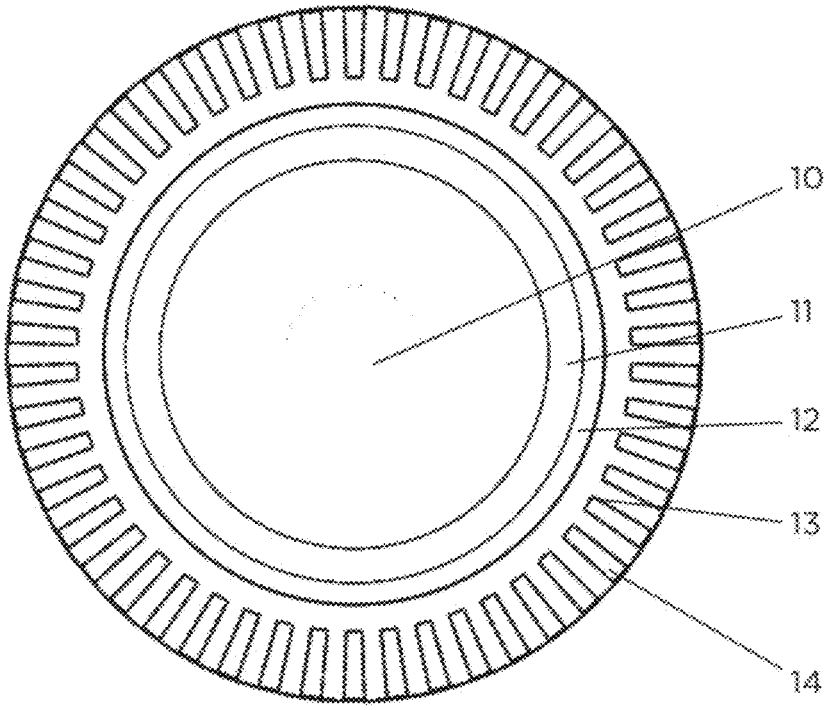
FIG. 3 is the top view of the device shown in FIG. 1.

FIG. 3 shows the top view of the replaceable, detachable, and interchangeable ridged top 10, with detachable interfaces 11 and 12, curved side structure 13 and ridges 14.

Figure 4:
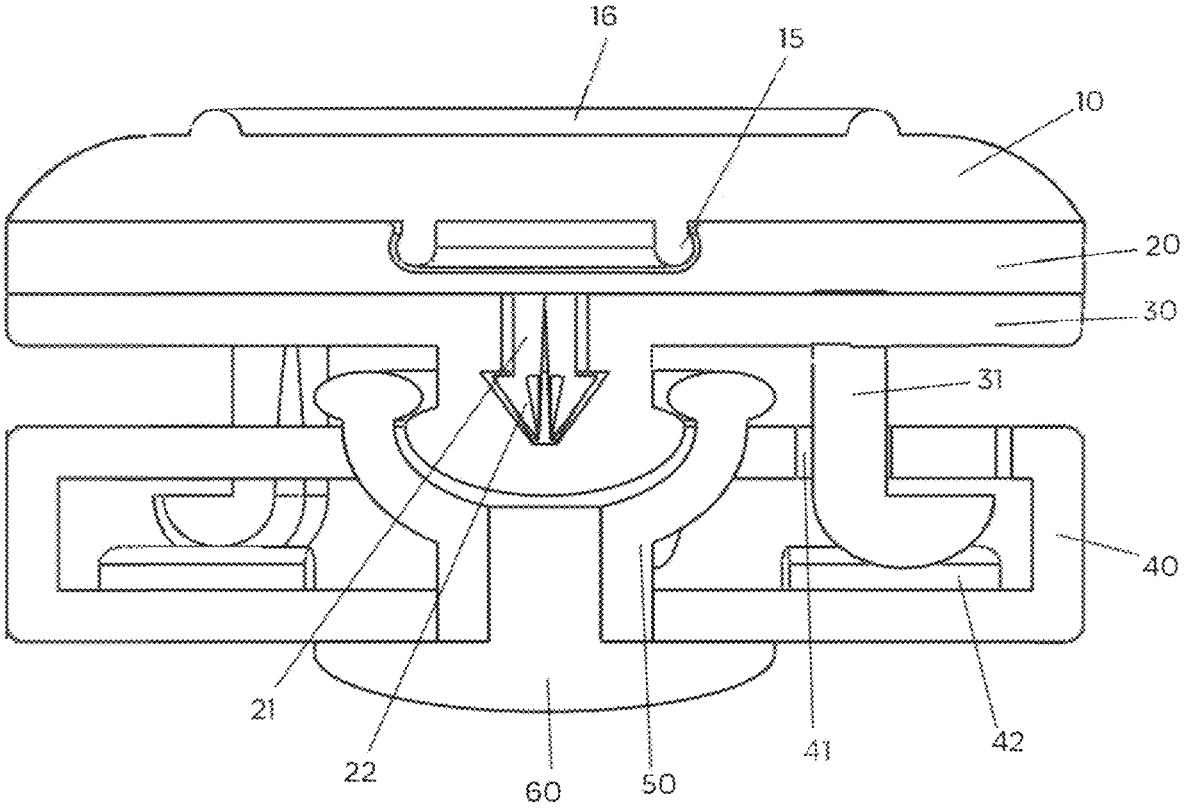
FIG. 4 is a cross-sectional view of the device shown in FIG. 1. taken from the center of the device.

FIG. 4 shows the cross-sectional view of the invention taken from the center of the invention. The replaceable, detachable, and interchangeable ridged top 10 is shown on top with detachable plate 16 inserted in the fixed position. Plate 16 may be color coded. Prongs 15 are shown which serve as attaching mechanism to plate 20 by snapping in place with applied downward force. Plate 20 with male fastener cylinder support structure 21 and pointed piercing structure 22, also cylindrically coned shaped, is shown connected to plate 30 with male fastener inserted in female fastener. Plate 30 with hinges 31 is connected to plate 40 with hinges 31 inserted in cavities 41 and rotated counterclockwise 37 to 42 degrees into a locked position. Bumper guides 42 guide hinges 31 into cavities 41 into a locked position keeping them from moving into the text cavity. Plate 30 is shown connected into structure 50 by snapping in place with applied downward force. Rivet 60 is shown detached from the invention and from an article of clothing.

Figure 5:
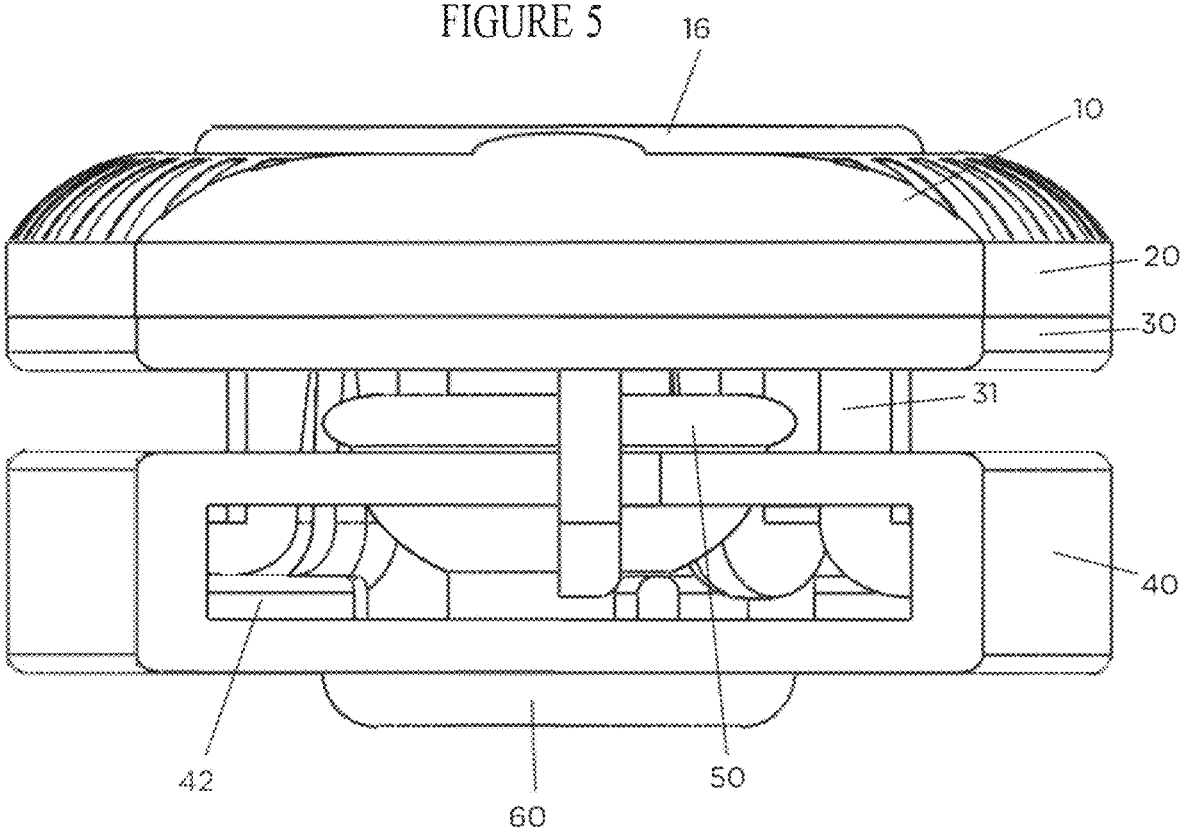
FIG. 5 is a cross-sectional view of the device shown in FIG. 1. taken closer to the edge of the device.

FIG. 5 shows the cross-sectional view of the invention taken from a location between the center of the invention and the side of the invention. This view in FIG. 5 shown the thickness of the wall of plate 40 while also showing the hollowed cylinder of plate 40 with sufficient space to receive hinges 31 with bumper guides 42 holding hinges 31 in place.

Figure 6:
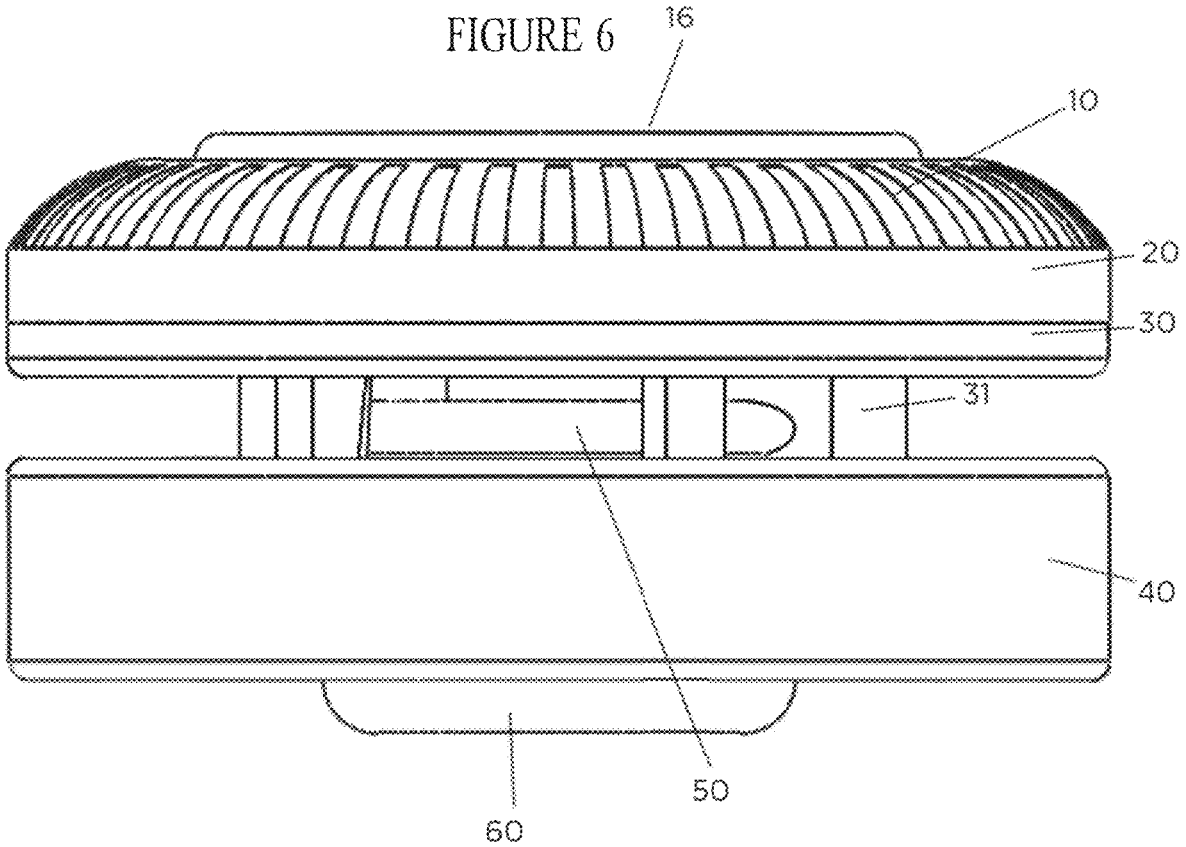
FIG. 6 is the side view of the device shown in FIG. 1.

FIG. 6 shows the side view of the completely closed invention.

Figure 7:
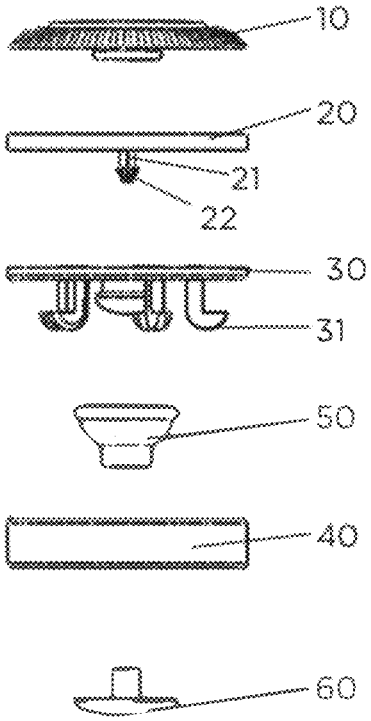
FIG. 7 is a semi-exploded view of the device shown in FIG. 1.

FIG. 7 is a semi-exploded side-view of the invention in the preferred embodiment. The replaceable, detachable, and interchangeable ridged top 10 is shown separated from the plate 20 with male fastener cylinder support structure 21 and pointed piercing structure 22. The plate 30 with hinges 31 is shown detached from the plate 20 containing the male fastener cylinder support structure 21 and pointed piercing structure 22. The plate 30 containing the female fastener and hinges 31 is shown detached from the plate 40 that receives the hinges 31. Structure 50 that receives the united plate 20 and plate 30 is shown detached from combined plates 20 and 30. Rivet 60 is shown detached from the invention and from an article of clothing.

Figure 8:
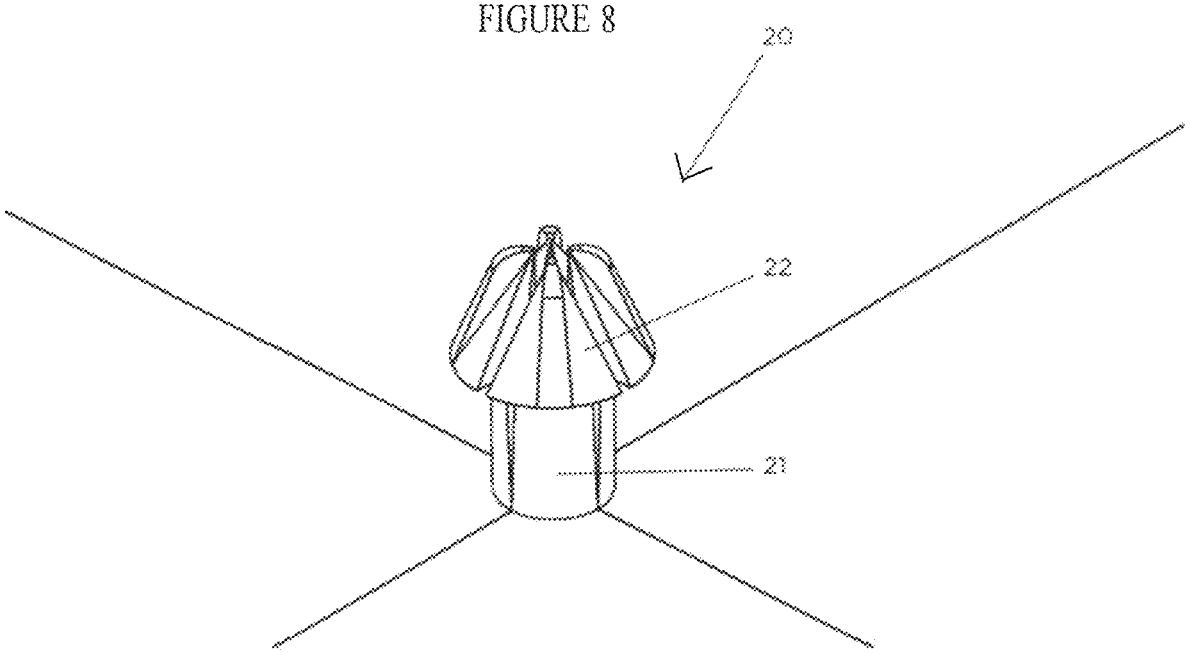
FIG. 8 is a detailed view of the male fastener.

FIG. 8 is the perspective view of the Plate 20 with male fastener cylinder support structure 21 and pointed piercing structure 22.

Figure 9:
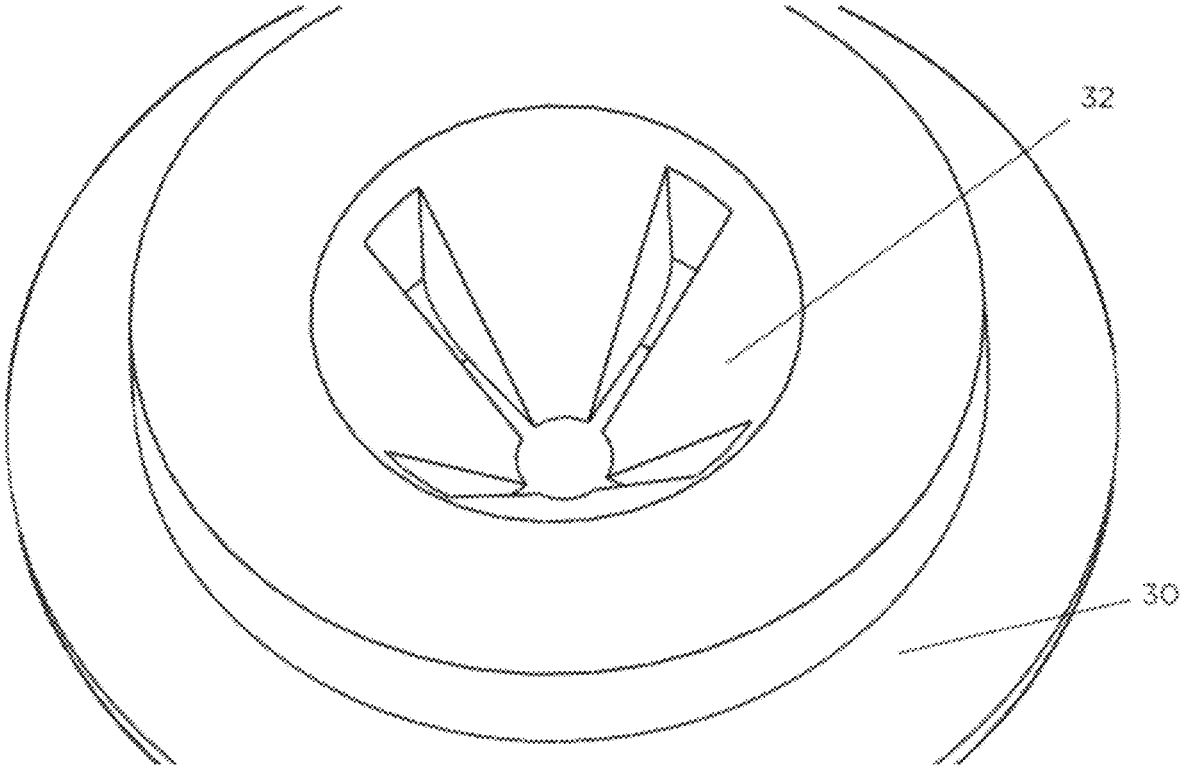
FIG. 9 is a detailed view of the female fastener.

FIG. 9 is the perspective view of the plate 30 containing the female fastener 32.

What is claimed is:

1. A button system for an article of clothing or any item requiring fastening, said button system comprising:

a top member and bottom member capable of incorporation into an article of clothing;

said top member consisting of a detachable, rotatable, and interchangeable ridged cover that is used as a pressure point to secure said top member to said bottom member, a male fastener that attaches to said ridged cover with a male fastener cylindrical support structure, and a plate with L-shaped hinges and a female fastener to secure all components of tile top member;

said bottom member consisting of a plate to receive said hinges from said top member, said plate with a cavity to allow the hinges to rotate counterclockwise 37 to 42 degrees into a locked position, and said plate with bumper guards to prevent the hinges from over rotation, and a rivet to attach to the article of clothing to the invention.

* * * * *